US009747779B2

(12) United States Patent
Harris et al.

(10) Patent No.: US 9,747,779 B2
(45) Date of Patent: Aug. 29, 2017

(54) DEVICES, SYSTEMS, AND METHODS FOR PROMOTING HYGIENE COMPLIANCE

(71) Applicant: Harkap Partners, LLC, Lafayette, IN (US)

(72) Inventors: Howard B. Harris, Indianapolis, IN (US); Michael A. Kaplan, Lafayette, IN (US); Todd P. Fricke, New Albany, IN (US)

(73) Assignee: Harkap Partners, LLC, Lafayette, IN (US)

( * ) Notice: Subject to any disclaimer, the term of this patent is extended or adjusted under 35 U.S.C. 154(b) by 0 days.

(21) Appl. No.: 14/629,468

(22) Filed: Feb. 23, 2015

(65) Prior Publication Data

US 2015/0170502 A1 Jun. 18, 2015

Related U.S. Application Data

(63) Continuation-in-part of application No. 13/069,700, filed on Mar. 23, 2011, now Pat. No. 8,963,721.

(60) Provisional application No. 61/316,655, filed on Mar. 23, 2010.

(51) Int. Cl.
*G08B 23/00* (2006.01)
*G08B 21/24* (2006.01)

(52) U.S. Cl.
CPC ..... *G08B 21/245* (2013.01)

(58) Field of Classification Search
None
See application file for complete search history.

(56) References Cited

U.S. PATENT DOCUMENTS

| | | | | |
|---|---|---|---|---|
| 5,945,910 A * | 8/1999 | Gorra | G08B 21/245 | 340/573.1 |
| 2002/0135486 A1* | 9/2002 | Brohagen | G08B 21/245 | 340/573.1 |
| 2009/0091458 A1* | 4/2009 | Deutsch | G06F 19/327 | 340/573.1 |

* cited by examiner

*Primary Examiner* — Brian Zimmerman
*Assistant Examiner* — Thomas McCormack
(74) *Attorney, Agent, or Firm* — Reichel Stohry LLP; Natalie J. Dean; Mark C. Reichel

(57) ABSTRACT

Devices, systems, and methods for facilitating hand hygiene compliance are provided including a device for dispensing hygiene maintenance material that also monitors a detection zone to determine if an individual is present. A hygiene facilitation system is also provided comprising a retrofittable hygiene facilitation device that can be mounted on, or collocated with, conventional hygiene devices. The devices, systems, and methods hereof provide alerts and, optionally, tracking of use of the dispensing device and the relation of that use compared to a desired use profile.

15 Claims, 10 Drawing Sheets

DEVICES, SYSTEMS, AND METHODS FOR PROMOTING HYGIENE COMPLIANCE

PRIORITY CLAIM

This application is a continuation-in-part of, related to, and claims the priority benefit of U.S. patent application Ser. No. 13/069,700 to Harris et al., filed Mar. 23, 2011, which is co-pending herewith as of this application's filing date and claims the priority benefit of U.S. Provisional Patent Application Ser. No. 61/316,655 to Harris et al., filed Mar. 23, 2010. The contents of each of the aforementioned applications are hereby expressly incorporated by reference in their entireties into this disclosure.

BACKGROUND

The present disclosure relates to devices, systems and methods for dispensing hand hygiene maintenance material. More specifically, the present disclosure relates to a dispenser of hand hygiene maintenance material that provides reminders and tracking of use of the dispenser and the relation of that use compared to a desired use pattern.

Healthcare-associated infections remain one of the most significant sources of morbidity and mortality among hospital patients worldwide. In the United States there are an estimated 1.7 million healthcare-associated infections in hospitals resulting in approximately 80-100,000 deaths each year adding $4.5 to $5.7 billion to patient care costs. Transmission of healthcare-associated pathogens most often occurs via the contaminated hands of health care workers due to failure to use proper hand washing technique or failure to hand wash altogether before every patient contact. Compliance rates for basic hand washing techniques have been cited between about 25-50%. Failure to remember to comply with hand washing protocol prior to every patient contact is probably the most significant factor for low compliance rates. Other factors including understaffing and overcrowding further exacerbate this problem.

Recognizing a worldwide need to improve hand washing in health care facilities the World Health Organization (WHO) launched its "Guidelines on Hand Hygiene in Health Care (Advanced Draft) in October 2005. These global consensus guidelines reinforce the need for multidimensional strategies as the most effective approach to promote hand hygiene. Key elements include adoption of alcohol-based hand rub as the primary method for hand hygiene and the use of performance indicators to assess the compliance with hand washing policies. Presently, the only routine monitoring of compliance involves direct visual observation of hand hygiene by hospital personnel. In the CDC's monograph many recommendations are indicated. These include: 1) to develop a device to facilitate the use and optimal application of hand hygiene agents, 2) to monitor hand hygiene adherence by ward or service staff and 3) to provide feedback to personnel regarding staff performance using the new device.

A definite correlation has been shown between improved hand hygiene compliance and a decreased incidence of hospital acquired nosocomial infections, including methicillin-resistant *staphylococcus aureus* (MRSA) infections. Furthermore, easy access to alcohol-based hand rub has been determined to be an independent predictor of improved hand hygiene compliance. In addition, 8 out of 9 hospital-based studies from 1977-2000 clearly demonstrate a temporal relationship between improved hand hygiene and reduced nosocomial infection rates, especially MRSA.

Another very recent incentive to reduce hospital-acquired infections was a new rule imposed by Medicare on Oct. 1, 2008, which stated their refusal to pay hospitals for catheter-associated urinary tract and vascular catheter-associated infections. It is likely that private insurance companies will soon put this same rule into effect. The incidence of both types of infections can be significantly reduced by adequate hand washing technique, which could save hospitals millions of dollars in reimbursements.

Visitors who do not use adequate hand washing techniques and then have direct contact with patients are another possible source of hospital acquired infections. This potential problem needs to be addressed and resolved as well.

Embodiments of the device of the present disclosure records hand hygiene compliance for all individuals who enter a monitored room. The recorded data can then be utilized to track compliance of a particular unit/ward to allow targeted training to improve compliance on that unit/ward. Immediate follow up data can also be supplied relating to the efficiency of the training. It can also track data at night and on weekends, when the presently used visual observation method is not routinely employed.

BRIEF SUMMARY

In at least one exemplary embodiment of the present disclosure, a hygiene facilitation device is provided that comprises two or more sensors, at least one display, a circuit board, and at least one data storage component. The two or more sensors comprise at least a first sensor configured to detect the presence of an individual moving through a detection zone and at least a second sensor configured to detect activation of a dispensing means that releases hygiene material from a hygiene material container upon activation. The at least one display is configured to provide visual information and is coupled with a first housing. Likewise, the circuit board is positioned within the first housing, comprises a processor, and is coupled with a power supply. Additionally, the circuit board in communication with each of the sensors and each of the display(s). The at least one data storage component is in communication with the processor and comprises parameters defining one or more trigger events and one or more sets of executable instructions stored thereon. For example, in at least one embodiment, the at least one data storage component is selected from the group consisting of on-board dedicated storage, a USB flash drive, random-access memory, flash memory, and a remote database associated with a server in communication with the processor over a network. Execution of a first set of executable instructions by the processor will cause the processor to provide negative feedback unless and until the dispensing means is activated. In at least one embodiment, the negative feedback comprises a light emitted through the at least one display.

Devices of the present disclosure may additionally comprise at least one speaker coupled with the first housing. In such embodiments, the at least one speaker is in communication with the processor and configured to provide audible information. Accordingly, the at least one speaker may be used (in connection with the display(s) or otherwise) to deliver the negative feedback.

The execution of the first set of executable instructions by the processor may be caused by the detection of a first trigger event. In at least one embodiment, the first trigger event comprises detection of any individual moving through the detection zone by the first sensor. Furthermore, the processor may additionally be configured to execute a second set of executable instructions stored on the storage component. In such embodiments, execution by the processor of the second set of executable instructions is caused by detection of a second trigger event. The second trigger event may comprise detection of activation of the dispensing means by the second sensor and execution of the second set of executable instructions by the processor may cause the processor to disregard any detection of the first trigger event that occurs within a second preset time of the second trigger event.

Referring back to the first set of executable instructions, in at least one embodiment, execution of the first set of executable instructions by the processor may cause the processor to additionally perform the steps of: (a) providing a first alert via at least one or more of the displays; (b) determining if the dispensing means is activated within a first preset time of a trigger event; and (c) choosing between and executing one of: if the dispensing means is activated within the first preset time, ceasing the first alert and logging a compliant event by saving a record to the data storage component, or if the dispensing means is not activated within the first preset time, providing a second alert via at least one or more of the displays and the first set of executable instructions further cause the processor to perform the step of choosing between and executing one of: if the dispensing means is activated within a second preset time of the trigger event, logging a compliant event by saving a record to the data storage component, or if the dispensing means is not activated within the second preset time, providing a third alert via at least one or more of the displays and logging a non-compliant event by saving a record to the data storage component.

As previously noted, the execution of the first set of executable instructions by the processor may be caused by the detection of a first trigger event, with the first trigger event comprising detection of any individual moving through the detection zone by the first sensor. In certain embodiments, the first sensor may be additionally configured to detect if the individual moving through the detection zone is associated with credentials that identify the individual as part of a particular group (e.g., an employee as opposed to a patron or patient). In such embodiments, the processor may be configured such that only the detection of credentials associated with the individual causes the processor to execute the relevant logging component of step (c) set forth above (i.e. either logging a compliant or non-compliant event by saving a record to the data storage component).

In additional embodiments of the device, information provided via the at least one display and/or the at least one speaker is programmable such that the information may be customized to each trigger event and/or each alert delivered. Additionally or alternatively, the processor may be communicatively coupled with a clock for measuring time, and the volume and/or brightness of the alerts delivered by the device may be customizable pursuant to the time of day indicated by the clock. Still further, the at least one first sensor may be adjustable such that the associated detection zone it monitors is modifiable in size, shape, and/or location. Additionally or alternatively, in certain embodiments, the size, shape, and/or location of the detection zone relative to the second sensor is customizable and the processor may be programmed such that any trigger event detected outside of the detection zone will not cause the processor to execute the first set of executable instructions.

In at least one embodiment of the devices of the present disclosure, the hygiene material container is positioned within the first housing and the dispensing means is coupled with the first housing. Accordingly, in such embodiments, the majority of the componentry of the device is positioned within, or coupled with, the first housing.

Alternatively, in at least one exemplary embodiment, the hygiene material container is positioned within a second housing, the dispensing means is coupled with the second housing, and the first housing is configured to couple with the second housing. There, for example, the first housing may be configured for retrofit mounting on the second housing. In still further embodiments, the first housing may further comprise a drip tray, with the first housing configured such that when the first housing is coupled with the second housing, the drip tray is positioned below the dispensing means of the second housing.

Alternatively, rather than mounting on the second housing, the first housing may be collocated with the second housing.

In yet another exemplary embodiment of the present disclosure, a retrofit hygiene facilitation system is provided. In such embodiments, the system comprises a hygiene device and a retrofittable hygiene facilitation device. There, the hygiene device comprises a hygiene material container and a dispensing means, the hygiene material positioned within a case and the dispensing means coupled with the case. The dispensing means of the hygiene device is configured to release hygiene material from the hygiene material container upon activation. The retrofittable hygiene facilitation device comprises a housing, two or more sensors, at least one display, at least one speaker, a circuit board, and at least one data storage component. The two or more sensors may optionally comprise a first sensor configured to detect the presence of an individual moving through a detection zone and at least a second sensor configured to detect activation of the dispensing means of the hygiene device. The at least one display may be coupled with the housing and configured to provide visual information, and the at least one speaker may be coupled with the housing and configured to provide audible information. The circuit board is positioned within the housing and comprises a processor. Additionally, the circuit board is coupled with a power supply and in communication with each of the sensors, the display(s), and the speaker(s). The at least one data storage component is in communication with the processor. Furthermore, the data storage component comprises parameters defining one or more trigger events and one or more sets of executable instructions stored thereon. In certain embodiments, execution of a first set of executable instructions by the processor causes the processor to perform the steps of: providing a first alert via at least one or more of the displays, determining if the dispensing means is activated within a first preset time of a trigger event, and if the dispensing means is activated within the first preset time, ceasing the first alert, or if the dispensing means is not activated within the first preset time, providing a second alert via at least one or more of the displays.

In at least one embodiment of the hygiene facilitation system disclosed herein, the execution of the first set of executable instructions by the processor is caused by the detection of a first trigger event. As previously noted, the first trigger event may comprise detection of any individual moving through the detection zone by the first sensor. Additionally, in at least one embodiment, the first sensor may be further configured to detect if the individual moving through the detection zone is associated with credentials. There, the processor may be configured such that the detection of credentials associated with the individual causes the processor to additionally execute a third set of executable instructions stored on the storage component, where execution of the third set of executable instructions by the processor causes the processor to additionally perform the step(s) of: if the dispensing means is activated within the first or second preset times, logging a compliant event by saving a record to the data storage component, or if the dispensing means is not activated within the first or second preset times: issuing a third alert via at least one or more of the displays, and logging a non-compliant event by saving a record to the data storage component.

Methods for facilitating hygiene compliance are also provided. In at least one exemplary embodiment of a method of the present disclosure, the method comprises the steps of: (a) detecting, with a first sensor, a first trigger event comprising any individual moving through a detection zone; (b) providing a first alert via at least one or more displays and/or speakers coupled with a hygiene compliance device; (c) determining if a dispensing means is activated within a first preset time of the first trigger event, the dispensing means configured to release a hygiene material from a hygiene material container upon activation; and (d) if the dispensing means is activated within the first preset time, ceasing the first alert, or (e) if the dispensing means is not activated within the first preset time, providing a second alert via at least one or more of the displays and/or speakers. In certain embodiments, step (d) of the method further comprises logging a compliant event by saving a record to the data storage component, and step (e) of the method further comprises the steps of issuing a third alert via at least one or more displays and/or speakers, and logging a non-compliant event by saving a record to the data storage component. Furthermore, where the first sensor is additionally configured to detect if the individual moving through the detection zone is associated with credentials, the method may further comprise the step: (f) detecting, with the first sensor, the presence of credentials associated with the individual moving through the detection zone; and relevant portions of steps (d) and (e) comprising logging a compliant or non-compliant event by saving a record to the data storage component is only performed if the individual moving through the detection zone is associated with credentials. Still further, the method may additional comprise the steps of: detecting, with a second sensor, a second trigger event comprising activation of the dispensing means; and ignoring any subsequent detection of the first trigger event that occurs within a second preset time of the second trigger event.

According to one additional embodiment, the present disclosure includes a hygiene compliance device including a housing; a hygiene maintenance material holder located within the housing; an interface member coupled to the housing that, when activated by a user, causes distribution of hygiene maintenance material from within the hygiene maintenance material holder to the user; an interface member sensor coupled to the housing that detects activation of the interface member; a signal emitter coupled to the housing; a signal sensor coupled to the housing that cooperates with the signal emitter to detect the presence of a person in a detection zone; a circuit board located within the housing and coupled to the signal emitter, the signal sensor, and the interface member sensor, the circuit board including a processor; and a data storage unit located within the housing and electrically coupled to the processor. The data storage unit has instructions thereon that, when interpreted by the processor cause the processor to perform the steps of: issuing commands to the signal emitter to emit a signal; receiving data from the signal sensor; processing the data received from the signal sensor to determine if an individual is located within a detection zone of the sensor; detecting activation of the interface member sensor; determining if the interface member sensor is activated within a first preset time of a detection of an individual within the detection zone; and choosing between and executing one of: logging a compliant event by saving a record to the data storage unit if the interface member is activated within the first preset time of the detection of the individual in the detection zone; and issuing an alert detectable by the individual if the interface member is not activated within the first preset time of the detection of the individual in the detection zone.

According to yet another embodiment, a method of monitoring hygiene compliance including the steps of: providing a hygiene compliance device to a hygiene sensitive location; providing for communication between the hygiene compliance device and a network; providing an adjustable signal emitter in the hygiene compliance device to monitor an ingress/egress point to the hygiene sensitive location; the hygiene compliance device further having a processor and a data storage unit. The data storage unit has instructions thereon, that when interpreted by the processor, cause the processor to perform the steps of: issuing commands to the signal emitter to emit a signal; receiving data indicative of the presence or lack of presence of an individual proximate the monitored ingress/egress point; processing the data received to determine if an individual is located within a detection zone of the sensor; detecting dispensing of hygiene compliance material from the hygiene compliance device; determining if the hygiene maintenance material is dispensed within a first preset time of a detection of an individual proximate the detection zone; and choosing between and executing one of: logging a compliant event by saving a record to the data storage unit if the interface member is activated within the first preset time of the detection of the individual in the detection zone; and issuing an alert detectable by the individual if the interface member is not activated within the first preset time of the detection of the individual in the detection zone.

Additional features of the present disclosure will become apparent to those skilled in the art upon consideration of the following detailed description of the illustrative embodiment exemplifying the best mode as presently perceived.

BRIEF DESCRIPTION OF THE DRAWINGS

The disclosed exemplary embodiments and other features and advantages thereof, as well as the manner of attaining them, will become apparent and the present disclosure will be better understood when taken in conjunction with the accompanying drawings, wherein.

Figure 1A:
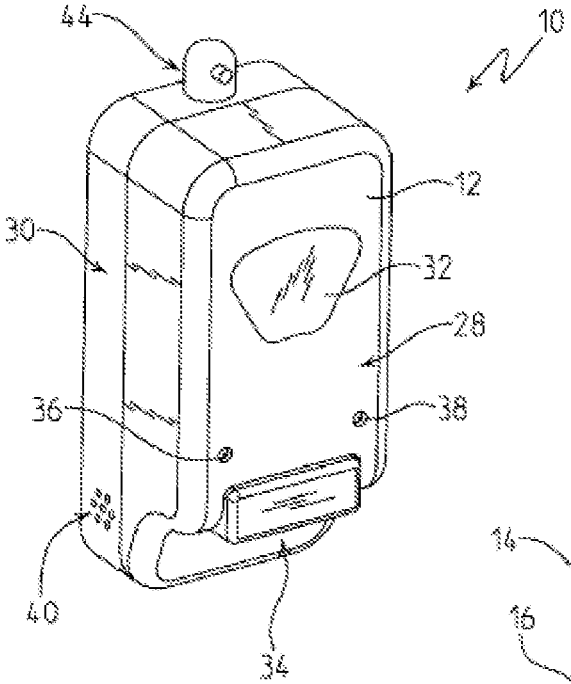
FIGS. 1*a*&*b* are perspective views of an exemplary embodiment of a hygiene maintenance device of the present disclosure.

An overview of the features, functions, and/or configurations of the components depicted in the various figures will now be presented. It will be appreciated that not all of the features and components of the devices, systems, and methods of the present disclosure are necessarily depicted in the figures. Likewise, it will be appreciated that not all of the features and components depicted in the figures are necessarily described. Some of the non-discussed features, such as various couplers, etc., as well as other discussed features are inherent from the figures themselves. Other non-discussed features may be inherent in component geometry and/or configuration.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended, with any additional alterations and modifications and further applications of the principles of this disclosure being contemplated hereby as would normally occur to one skilled in the art. On the contrary, it is intended to cover alternatives, modifications, and equivalents as may be included within the spirit and scope of this application as defined by the appended claims. While this technology may be illustrated and described in a preferred embodiment, the devices, systems, and methods hereof may comprise many different configurations, forms, materials, and accessories.

For example, the systems, methods and techniques of the present application will be described in the context of a hand sanitizing model. However, it should be noted that the devices, systems, methods, and techniques of the present application apply in a wide variety of contexts including, but not limited to, other sanitation or hygienic applications that benefit from monitoring, timing and/or recording compliance.

In the following description, numerous specific details are set forth in order to provide a thorough understanding of the present disclosure. Particular examples may be implemented without some or all of these specific details. In other instances, well known process operations and/or system configurations have not been described in detail so as to not unnecessarily obscure the present disclosure.

Various techniques and mechanisms of the present disclosure will sometimes describe a connection between two components. Words such as attached, affixed, coupled, connected, and similar terms with their inflectional morphemes are used interchangeably, unless the difference is noted or made otherwise clear from the context. These words and expressions do not necessarily signify direct connections, but include connections through mediate components and devices. It should be noted that a connection between two components does not necessarily mean a direct, unimpeded connection, as a variety of other components may reside between the two components of note. For example, a hygiene maintenance device of the present disclosure may be in communication with a server, but it will be appreciated that a variety of bridges and controllers may reside between the device and the server. Consequently, a connection does not necessarily mean a direct, unimpeded connection unless otherwise noted.

The embodiments of the disclosure described herein are not intended to be exhaustive or to limit the invention to precise forms disclosed. Rather, the embodiments selected for description have been chosen to enable one skilled in the art to practice the disclosure. Furthermore, wherever feasible and convenient, like reference numerals are used in the figures and the description to refer to the same or like parts or steps. The drawings are in a simplified form and not to precise scale.

Figure 1B:
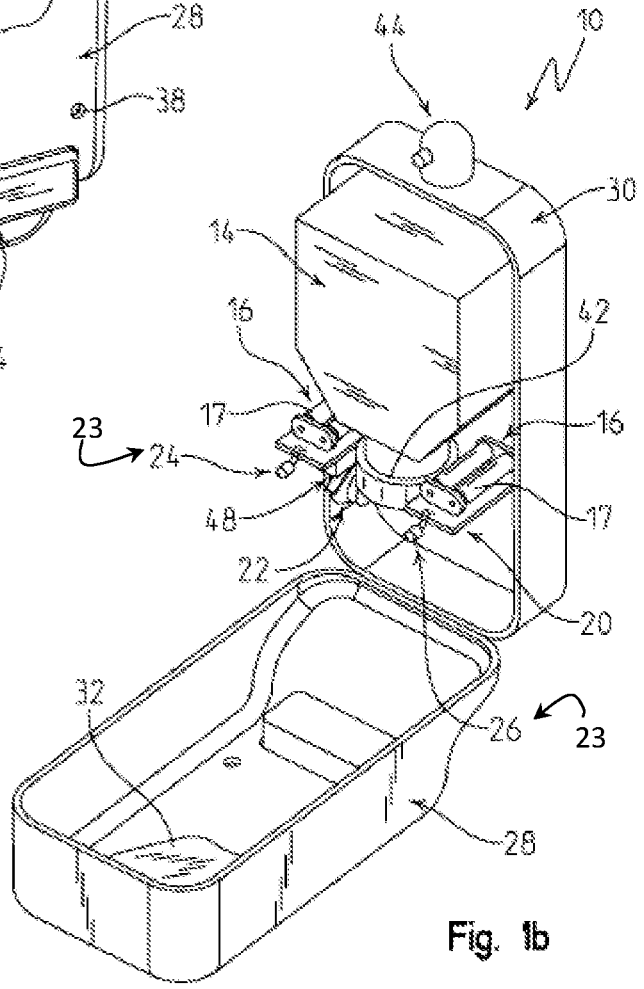
FIG. 1*c* is an overhead schematic view of at least one exemplary embodiment of a room setup using the hygiene maintenance device of FIGS. 1*a* and 1*b;*

FIGS. 1*a* and 1*b* show at least one exemplary embodiment of a hygiene maintenance device 10 of the present disclosure. Hygiene maintenance device 10 is shown as a dispenser of soap, sanitizing solution, or hand rub such as an antiseptic hand rub. Device 10 provides an auditory and visual reminder to use it, an alcohol- (or otherwise) based hand rub and a compliance monitoring system all in an easy to use and customizable unit.

Device 10 is configured to be mounted on a wall or other flat surface (such as a cabinet), or on an independent portable stand close to the entrance to a patient's room or any other area where proper hand hygiene is deemed important. Device 10 includes housing 12, sanitizer container 14, battery holders 16, batteries 17, circuit board 20, speaker 22, and at least one display 23 (as shown in FIGS. 1*a* and 1*b*, the at least one display 23 may comprise a status LED 24 and a fault LED 26).

In at least one embodiment, housing 12 comprises a front half 28 pivotally coupled to a back half 30 and is substantially similar to soap/alcohol dispensers known in the art. Front half 28 includes window 32, dispensing means 34, and display windows 36, 38. In this embodiment, front half 28 pivots relative to back half 30 to allow access to the interior of housing 12 for servicing of device 10, including fixing malfunctions, refilling/replacing sanitizer container 14, and replacing batteries 17. It will be appreciated that housing 12 need not comprise front and back halves 28, 30 hingedly or pivotally coupled together; indeed, the housing 12 may comprise any configuration that is capable of both supporting the components of the device 10 as necessary to facilitate the operation thereof and providing access to the same as appropriate for device 10 maintenance and/or repair.

Window 32 allows a user to see into the interior of the housing 12 to visualize sanitizer container 14 and may be optionally included on the housing 12. Dispensing means 34 is configured to be pressed otherwise activated by a user to cause dispensing of sanitizer from device 10. In at least one embodiment, dispensing means 34 is hingedly coupled to back half 30 and configured to dispense sanitizer upon physical depression. Alternatively, dispensing means 34 may not be designed for physical contact at all, but instead comprise a touch free mechanism configured to dispense sanitizing product when activated (for example comprising an infrared sensor, motion sensor, capacitive flux sensor, etc. to detect the placement of a hand or other object in the detection zone).

Each display window 36, 38 aligns with at least one display 23 (as shown in FIGS. 1*a* and 1*b*, LED's 24, 26) when front half 28 is in a closed position to allow a user to view stimuli produced by the display 23. For example, as shown in FIGS. 1*a* and 1*b*, light produced by LED's 24, 26 is visible through LED windows 36, 38, respectively. The at least one display 23 can be used to provide visual alerts relating to the device 10 and/or an individual's use (or non-use) thereof. A display 23 of the device 10 may comprise an LED or other light source, a text display, or any other display now known or hereinafter developed that is operable to provide a visual alert to a user. Specific displays 23 may be designated to indicate specific types of information to a user. Additionally, a display 23 may be configured to generate two or more colors. In such embodiments, each color may be assigned a different meaning and used to inform a user of the current status of the device 10 or other relevant information.

For example, and without limitation, a status LED 24 may provide an indication of the operational status of hygiene maintenance device 10. Status LED 24 can operate in a plurality of ways, including emitting a static light and/or various combinations of flashes to indicate various operational states, or by producing different colors to indicate various operational states (i.e. if a static green light is emitted from a display 23, it is an indication that the device 10 is fully operational). Additionally, status LED 24 may provide an indication that an object has moved through a defined sensor zone (if a pulsing yellow light is emitted from a display 23, for example). Similarly, fault LED 26 may provide an indication of operational faults or low battery/power (or loss of power) (e.g., a static red light is emitted from fault LED 26). LED 26 can communicate this in any of the ways described with respect to status LED 24. Back half 30 of the housing 12 comprises sanitizer container mount 42, sanitizer container 14, battery holders 16, circuit board 20, speaker 22, display(s) 23, one or more sensor/emitters 44, and speaker port 40. Sanitizer mount 42 provides a quick disconnect mount that readily receives and releases sanitizer container 14 while providing a leak-free connection for sanitizer container 14 that allows dispensing of the contents of sanitizer container 14. Sanitizer container 14 is either a disposable or refillable container of the sanitizer to be dispensed by device 10. Battery holders 16 hold batteries 17 and are electrically coupled to circuit board 20.

Circuit board 20 includes a processor 46 thereon as well as a plurality of input/output/power ports. The input/output/power ports are coupled to portions for detection (such as sensor/emitter 44), for providing alerts (such as display(s) 23 (e.g., LED's 24, 26) and speaker 22), for powering the device (such as battery holders 16 and batteries 17, or components associated with a hard-wired or power-outlet based system), for determining the amount of sanitizer remaining in sanitizer container 14, for communicating with other devices, and for saving data. The processor 46 comprises any integrated circuit known in the art or hereinafter developed that is capable of running programs and controlling the various components of the device 10. Functionally, the processor 46 comprises the brain of the hygiene maintenance device 10 and can be programmed to control and/or customize the various operational aspects thereof. For example, sequence-specific instructions may be programmed in the processor 46 (and optionally associated with user-defined time periods) such that the device 10 can be used to facilitate hygiene compliance.

In at least one exemplary embodiment, when the hygiene maintenance device 10 is in use, the processor 46 is configured to spend the majority of the time in a lower-power sleep state to conserve battery life or power. As is described in further detail herein, various functions of the device 10 may act to "wake-up" the processor 46 and/or the processor 46 may be programmed to "wake-up" periodically to perform various functions, such as, for example, system checks to ensure optimal functionality of the device 10 and/or to communicate locally stored data to a central server.

Speaker 22 is coupled to circuit board 20 and provides audible commands or alerts, or information generally. Speaker port 40 aligns with speaker 22 to readily allow sounds to emanate therefrom. The device 10 may be programmed such that the speaker 22 and one or more displays 23 work in concert to provide audible and visual alerts, and/or so that such alerts operate independent of each other. In at least one exemplary embodiment, device 10 can be programmed to adjust alert characteristics pursuant to an internal clock such that audible alerts can be reduced in volume or silenced as desired. Such an internal clock will also be beneficial in determining compliance rates during different time periods.

Additionally or alternatively, a user can define particular time periods during which only a visual alert is provided (or only an audible alert), and other time periods where both audible and visual alerts are provided. For example, while both audible and visual alerts may be preferred during the day, at night it may be desirable to limit the alerts to visual alerts delivered via the display(s) 23 or to reduce the volume of the audible alerts. Additionally or alternatively, certain alerts may be delivered through the speakers 22 in an audible fashion, while other alerts may be limited to visual delivery through the display(s) 23.

It will be appreciated that the device 10 is fully customizable such that a user can establish one or more alert profiles, thereby assigning specific alert characteristics to particular events and/or customizing the manner in which alerts are delivered (i.e. via sound and/or sight) during particular times of the day. Indeed, a user may customize the text of a text display 23, define the color(s) associated with different events and alerts, and/or associate particular events with particular audio content (e.g., select a particular tone, melody, song or voice instructions to play in response to particular input received by the device 10).

Now referring back to FIGS. 1*a* and 1*b*, the hygiene maintenance device 10 also comprises at least one sensor/emitter 44. Sensor/emitter 44 may be integrated or coupled with the housing 12 of the hygiene maintenance device 10 and is illustratively an infrared motion sensor/emitter. As shown in FIGS. 1*a* and 1*b*, a sensor/emitter 44 may be located at the top of back half 30, however, sensor/emitter(s) 44 may be positioned in other locations on the device 10 as well. Sensor/emitter 44 is configured to emit a signal into a detection zone and thereafter sense the signal that is reflected by the surroundings back to sensor/emitter 44. More specifically, in at least one embodiment, the sensor/emitter 44 utilizes infrared sensing technology across a narrow spectrum (multiple "rays") to detect an object moving through its field/the detection zone. The sensor employed may be "tuned" more specifically towards the heat signature of a person to limit detection of a moving door or moving piece of equipment.

While the foregoing example is based on the sensor/emitter 44 comprising both an emitter and a sensor that coordinate with one another and rely on a processor, it will be appreciated that other sensor devices may be employed. For example, in at least one embodiment, the sensor/emitter 44 may consist of only a sensor configured to detect the presence of a person or other large object passing through the detection zone. Unlike sensor/emitter/processor combinations, an individual sensor can operate passively such that it utilizes much less power in operation and in waking the processor to execute subsequent actions.

Optionally, more than one sensor/emitter 44 may be used with a single hygiene maintenance device 10. Furthermore, in at least one embodiment, one or more of the sensors/emitters 44 may be configured to detect and/or respond to the presence of credential information. In such cases, the sensors/emitters 44 of the device 10 can be used to recognize and identify an individual's credentials (such as a badge, for example) when he or she moves through the relevant detection zone. In this manner, the device 10 can not only detect the presence of an individual, but can also automatically distinguish between different groups of individuals (for example, employees versus patrons). It will be appreciated that sensors/emitters 44 configured to identify unique credentials may be used in conjunction with or instead of the non-discriminate sensor/emitters 44 previously described herein. Whereas one embodiment of the device is described above, various alternatives are envisioned. More specifically, whereas the sensor/emitter 44 is described as a motion sensor device, in other embodiments sensor/emitter 44 may additionally or alternatively utilize a light gate, RFID, ultrasound, a thermal sensor, or any other suitable sensor known in the art. Furthermore, whereas sensor/emitter 44 has been previously described as being integrated with hygiene maintenance device 10, alternative embodiments comprise a sensor/emitter 44 that is separate and apart from hygiene maintenance device 10 such that it may be positioned remotely therefrom. Additionally, it is contemplated that the device 10 may comprise more than one sensor/emitter 44, the sensor/emitters 44 coupled or integrated with the front half 28 or back half 30 of the hygiene maintenance device 10, positioned remotely, or a combination thereof.

Figure 1C:
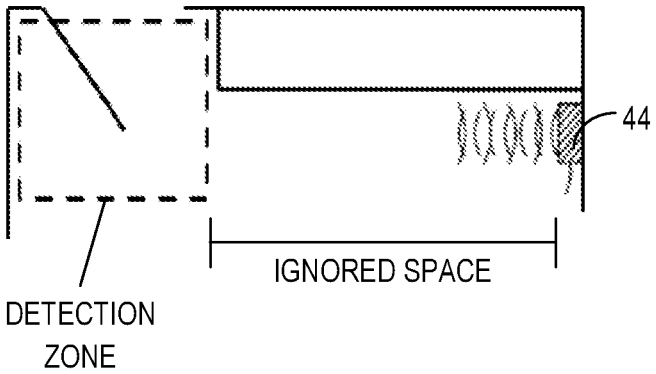

Each sensor/emitter 44 can have a fixed aim or can be adjustable such that the coverage of its detection zone can be adjusted upon installation or even thereafter. As previously noted, the signal emitted from each sensor/emitter 44 defines a detection zone, which is a defined area that is monitored by that particular sensor/emitter 44. The size and shape of this detection zone can either be pre-set (as with a sensor/emitter 44 having a fixed aim) or, where the sensor/emitter 44 is adjustable, the size and shape of the detection zone may be customizable such that it can be tailored to accommodate a particular space. As such, the sensor/emitter(s) 44 may be set such that the detection zone comprises a uniform radius or, alternatively, so that the reach of the sensor/emitter 44 signal of the present device 10 accounts for barriers (whether non-uniform or otherwise) or an irregular arrangement. In this manner, a facility/user of the device 10 can be selective in the area covered/monitored, thereby providing reliable and effective monitoring without disrupting individuals who are located in non-targeted, albeit adjacent, area. A schematic example of one such irregular arrangement is shown in FIG. 1*c*. Perhaps more specifically, FIG. 1*c* illustrates a sensor/emitter 44 comprising an ultrasound configured to detect a person passing through the entry zone (i.e. the detection zone). Because the sensor/emitter 44 uses ultrasound sensing to measure distance, the processor 46 can be programmed to ignore the space between the sensor/emitter 44 and the detection zone, as well as space beyond, or otherwise outside of, the detection zone (see, for example, FIG. 6*a*). In this manner, a person moving through the detection zone will be noted by the sensor/emitter 44, but a person moving through an ignored space (i.e. a space outside of the defined detection zone) will not. Accordingly, each sensor/emitter 44 may be set to monitor a specific detection zone that may be customized in size, shape, and location relative to the sensor/emitter 44 as desired.

Each of the detection methods provide opportunities to customize the detection profiles (the conditions under which a detection of a user is considered to have been triggered, the occurrence of which is referred to herein as a "trigger event"). The detection profiles can either be fixed as a factory setting or can be adjustable by an installer or other individual to customize hygiene maintenance device 10 to suit its particular application setting. In perhaps its simplest form, a detection profile may be defined such that if any person walks through the detection zone (irrespective of credentials or other identification information), the sensor/emitter(s) 44 sends a signal to the processor 46 that a trigger event has occurred. Alternatively, a detection profile may be defined such that while the device 10 recognizes any individual traversing the detection zone as a trigger event, the processor 46 executes different logic depending on whether or not the individual is identified as having particular credential information. For example, where a childcare facility employs the hygiene maintenance device 10 in a restroom to monitor and promote hand washing, the detection profile may be defined so that the processor 46 initiates one protocol if a sensor/emitter 44 detects that the individual triggering the event is a non-credentialed individual (e.g., a child or parent) and separate protocol if a sensor/emitter 44 detects that the individual triggering the event is a credentialed individual (i.e. an employee). In at least one exemplary embodiment, the processor 46 may be programmed to log data regarding a trigger event in the case of a credentialed individual. Conversely, the processor 46 may be programmed to log data regarding all trigger events (regardless of whether or not the individual was carrying credentials), but record additional detail for those trigger events caused by an individual with credentials (e.g., the credentialed individual's identification information or any other information that may be desired or useful).

Additionally or alternatively, a detection profile may also be programmed such that the dispensing of sanitizer via the dispensing means 34 negates any trigger event that subsequently occurs within a prescribed period of time (e.g., 5 seconds). For example, consider a hygiene maintenance device 10 positioned so that the detection zone monitors the ingress/egress area of a room. In accordance with many hand hygiene guidelines, individuals are required to sanitize their hands not only upon entering a room, but prior to exiting as well. Using the previously described detection profiles to illustrate this concept, when an individual enters the room, the sensor/emitter(s) 44 detects the individual in the detection zone, sends a signal to the processor 46 that a trigger event has occurred, and the individual is prompted to sanitize his or her hands using the device 10. However, when the individual leaves the room, he or she does so through the same detection zone. As such, without a mechanism through which to discount the trigger event resulting from their departure (i.e. walking through the detection zone), the device 10 may identify false-noncompliant events.

To prevent this, the detection profile may be defined to recognize an exception for a period of time after dispensing means 34 is operated. In this manner, if an individual uses the device 10 to sanitize his or her hands prior to exiting the room, the processor 46 is instructed to disregard or ignore the trigger event that occurs when he or she traverses the detection zone upon their departure. The duration of time during which this exception is recognized may be customized, for example, depending on where the hygiene maintenance device 10 is located relative to the detection zone. Additionally or alternatively, one or more sensor/emitter(s) 44 capable of determining an individual's direction of travel through the detection zone may also be employed (such as multiple light beams, for example) to prevent any such false-noncompliant events.

It will be appreciated that any number of detection profiles may be used in connection with a device 10 and that they are fully customizable, if desired. While examples of particular detection profiles are provided herein, it is understood that these are provided by way of explanatory examples and not intended to be limiting.

The one or more displays 23 (for example, LEDs 24, 26) and speaker 22 can provide different ways of signaling that a detection (or trigger event) has occurred. As previously noted, displays 23 can provide solid on or off settings, as well as flash patterns, and differing colors and/or text to prompt an individual and/or indicate various things. Similarly, audible alerts provided via speaker 22 can be provided in the form of tones, music, or voice prompts. Additionally, and as previously noted, multiple alerts can be provided concurrently or in conjunction with each other, and the timing of such alerts relative to other events can either be a factory setting or adjustable by an installer or user.

The embodiment of FIGS. 1*a* and 1*b* shows batteries 17 and battery holders 16. Alternatively or additionally, power can be provided via a traditional AC plug, a power cord that couples to a PC (USB or otherwise), or the hygiene maintenance device may be configured to be hard-wired to a facility electrical system. Thus, batteries 17 can be either a primary or a secondary (back-up) power source. For example, it may be preferable that the hygiene maintenance device 10 is hard-wired to the facility electrical system, but also incorporates battery holders 16 and batteries 17 as a back-up power source (e.g., in the event of a power outage).

Figure 2:
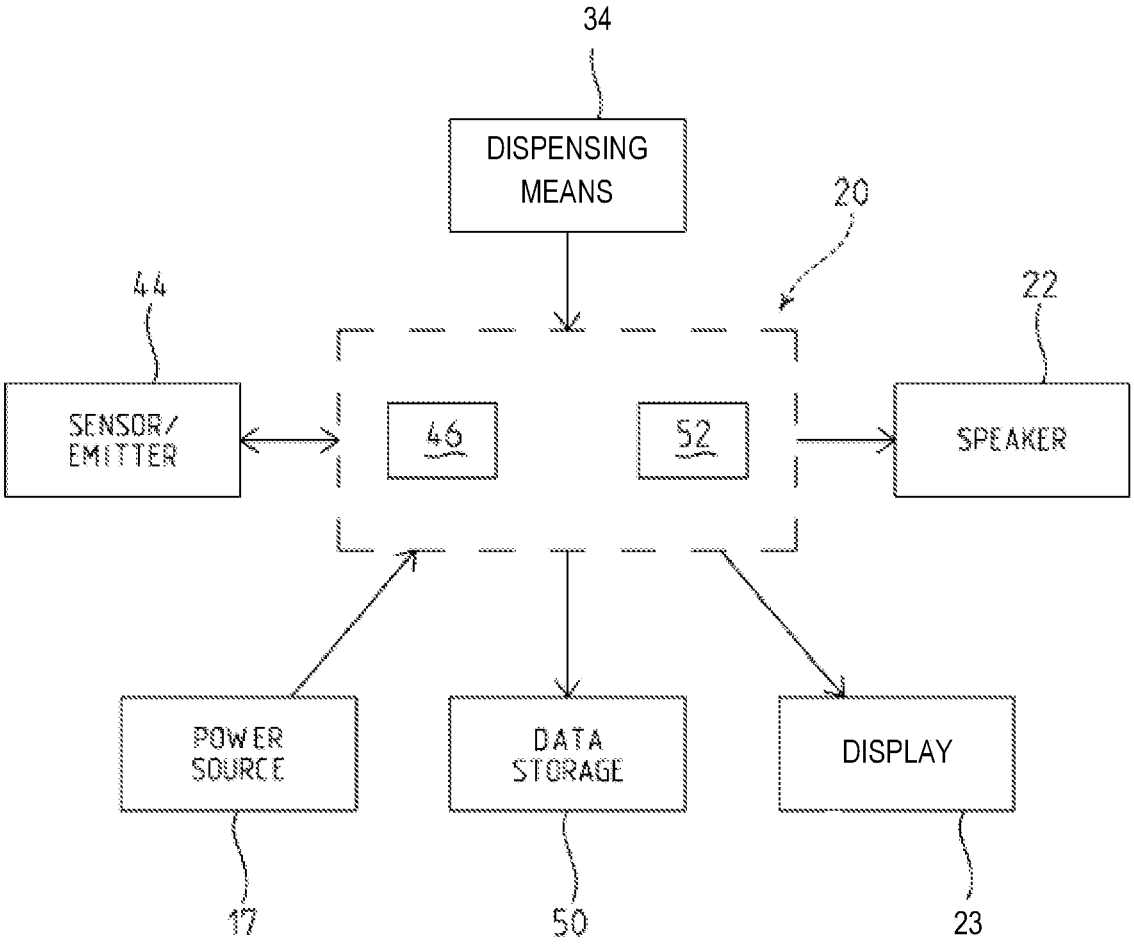
FIG. 2 is a schematic diagram of the inputs and outputs for a microprocessor and a circuit board of the hygiene maintenance device of FIGS. 1*a* and 1*b;*

Now referring to FIG. 2, a schematic view of circuit board 20 and various componentry of the device 10 is provided. As shown in FIG. 2, circuit board 20 is coupled to storage component 50 and is in communication with communications components 52. In at least one embodiment, storage components 50 store the programming used to operate hygiene maintenance device 10 and other configuration settings (e.g., detection profiles and alert protocols).

Storage components 50 may also be used to store operational data indicative of how hygiene maintenance device 10 has been used or unused, as well as data relating to compliance with a prescribed use protocol. This data storage can take several forms, including but not limited to, removable media, on board dedicated storage, and data storage internal to the processing component(s). Embodiments are envisioned where device 10 includes memory such as a memory card/stick, jump drive, or other local memory (removable or otherwise) for storing data (e.g., USB flash drive, microUSB flash drive, random-access memory, flash memory, etc.). Such embodiments optionally operate without an infrastructure for networked monitoring, or may be used in conjunction therewith as on-device storage for back-up purposes. In still another embodiment, processor 46 detects the connection of a jump drive (or thumb drive) connected via a USB port or otherwise and automatically uploads stored data thereto. Such embodiment could additionally operate without the need for a dedicated computer or network infrastructure and, thus, allow for a system administrator to manually retrieve the recorded data for subsequent analysis without the need for a communications infrastructure connecting each device 10 to a host computer/server.

Communications components 52 allow data to be transferred between hygiene maintenance device 10 and other computing devices, such as a central computer coupled to a plurality of hygiene maintenance devices 10. Use of communications components 52 allows data to be saved to or pulled from storage components 50 on the individual devices 10. Communication components 52 may comprise components for wired or wireless networking, or for direct coupling to a computer. The wired components may include those for connection to a LAN, Ethernet based system (such as an RJ-45 interface), or any other similar network now known or hereinafter developed. Wireless networking components may be those used in connection with traditional Wi-Fi or a wireless MESH network (WMN) operating according to the Zigbee standard or otherwise. Direct coupling components are those suitable for providing USB, Serial, firewire, or other now known or hereinafter developed transmission interfaces.

As previously described, device 10 can communicate with another computer via a direct connection, wirelessly, or through a network for the purposes of transmitting stored data and/or changing/customizing the program presets (i.e. a user can connect to an individual device via a USB cable connected to their laptop or portable computer). As previously noted, the device 10 may optionally operate without an infrastructure for networked monitoring. Alternatively, where a networked configuration and/or communications infrastructure is employed, a user can access device 10 via the network such that the program presets of the device 10 can be modified remotely. This networked configuration may be particularly useful where a plurality of hygiene maintenance devices 10 are employed throughout a single large facility. Furthermore, via the network or direct connectivity, other aspects of the device 10 may be modified, such as adjusting the volume of audible alerts, on the room, ward, facility, or other level.

Device 10 further includes switch 48 that is coupled to or integral with dispensing means 34. Switch 48 comprises a limit switch, a micro switch, a position switch, a noncontact sensor (such as, without limitation, a hall-effect, capacitance, magnetic reed, or optical sensor), or any other suitable switch. Switch 48 allows for detection of the use of dispensing means 34 and thus the dispensing of sanitizer. Software also receives input from switch 48 to count the number of times dispensing means 34 is activated (e.g., pressed) and may use information regarding the last refill/replacement of sanitizer container 14 to produce an approximation on the amount of sanitizer remaining in sanitizer container 14. In this manner, the hygiene maintenance device 10 can proactively self-monitor and the appropriate staff can be alerted when sanitizer container 14 is running low on sanitizer (for example, via a display 23 or otherwise).

Figure 3A:
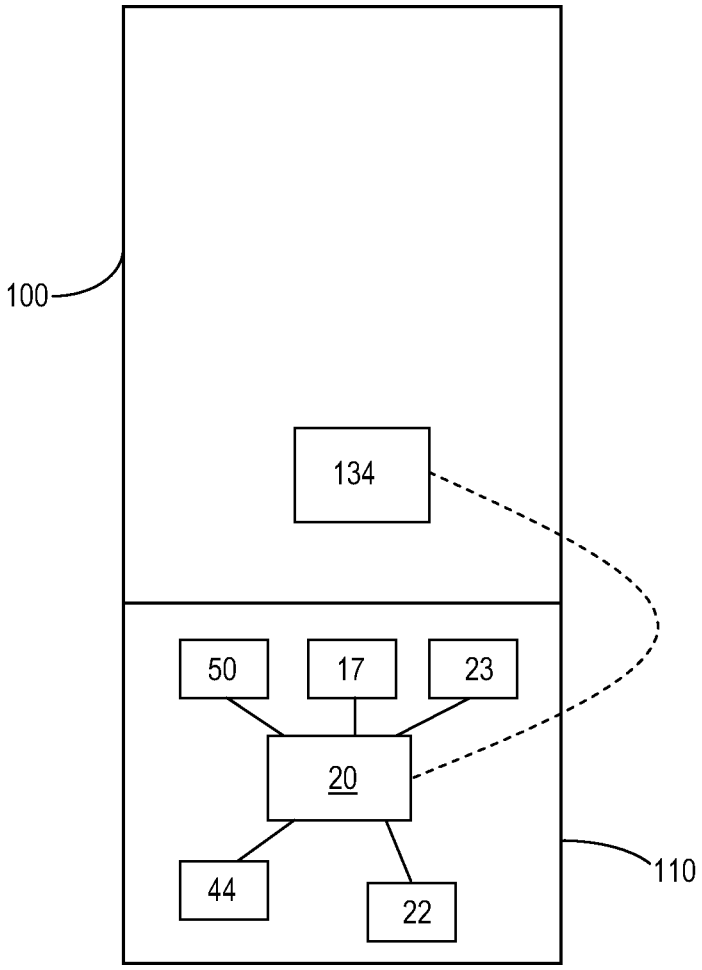
FIG. 3*a* shows a schematic diagram of an exemplary embodiment of a retrofit hygiene facilitation device of the present disclosure.

Alternative embodiments of the hygiene maintenance device of the present disclosure may comprise a retrofit configuration that operates in conjunction with a conventional hand hygiene device. For example, now referring to FIG. 3*a*, a schematic diagram representative of a hygiene facilitation system is shown pursuant to an exemplary embodiment of the present disclosure. The hygiene facilitation system comprises a conventional hand hygiene device 100 and a retrofittable hygiene facilitation device 110.

In at least one embodiment, the retrofit device 110 is configured similarly to the hygiene maintenance device 10 in that it comprises all of the electronic componentry thereof—a circuit board 20 coupled with a speaker 22, one or more displays 23, data storage 50, at least one sensor/emitter 44, and a power source 17. Furthermore, each of these components may be interrelated in the same manner as described in connection with the hygiene maintenance device 10. However, unlike hygiene maintenance device 10, the retrofit device 110 does not itself comprise a sanitizer container or a dispensing means. Instead, the retrofit device 110 is configured to couple with or be positioned adjacent to a conventional hand hygiene device 100 such that it operates therewith. Accordingly, the retrofit device 110 comprises less componentry than the hygiene maintenance device 10 and, as such, manufacture of the retrofit device 110 is simplified.

Many facilities utilize conventional hand hygiene devices 100. Such devices typically comprise a dispenser of soap or hand rub that includes a sanitizer container (not shown) positioned within a case and a dispensing means 134 coupled with the sanitizer container. The dispensing means 134 can be activated by a user's hand or otherwise to cause the soap or other substance in the sanitizer container to be dispensed from the device 100. The dispensing means 134 of the conventional device 100 may comprise a handle activated by a user physically pushing or pulling the same, a touch-free mechanism activated when an object (such as a hand) is placed into an opening thereunder (operable via a sensor, for example), or any other dispensing mechanism known in the art.

As previously noted, the retrofit device 110 is configured to conveniently couple, or be collocated, with a conventional hand hygiene device 100. For example, in at least one embodiment, the retrofit device 110 may comprise a plastic, outer casing that is designed to snap onto, or otherwise securely couple with, the conventional hand hygiene device 100. In this manner, if the conventional device 100 has been previously mounted to a surface such as a wall, the device 100 will support the retrofit device 110 and no additional mount is necessary.

Figure 3B:
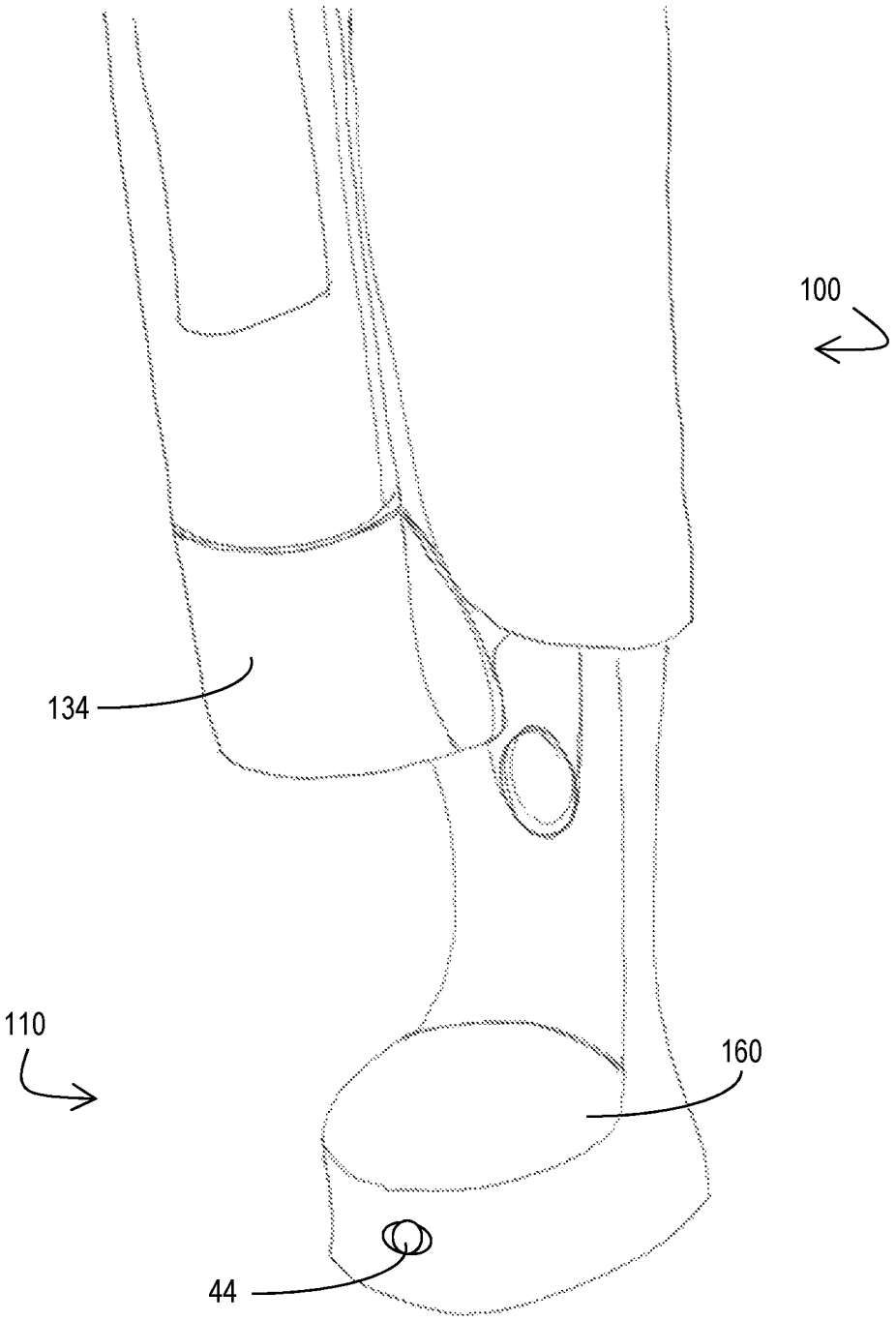
FIG. 3*b* shows a perspective view of at least one exemplary embodiment of the retrofit hygiene facilitation device of FIG. 3*a;*

One such example of a retrofit device 110 designed to couple with a conventional device 100 is shown in FIG. 3*b*. In addition to the other previously discussed components of the retrofit device 110, the retrofit device 110 may further comprise accessories that correspond with and/or provide beneficial features to the conventional device 100. For example, as shown in FIG. 3*b*, the retrofit device 110 may additionally comprise a drip tray 160, a towel dispenser (not shown), or the like.

Alternatively, the hygiene facilitation system may be configured such that the retrofit device 110 is collocated with the conventional device 100. In such embodiments, the retrofit device 110 may further comprise its own mount and can be positioned independently of the conventional hand hygiene device 100. A collocated retrofit device 110 may also comprise accessories to the conventional device 100 as may be desired and/or appropriate.

In at least one embodiment, the circuit board 40 of the retrofit device 110 is in communication with the sanitizer container of the conventional device 100. This may be accomplished through a direct, wired connection or via remote sensors. One of many types of switches or detectors such as a push button switch, magnetic switch, capacitance switch or optical switch could be added to the conventional device 100 to detect when a user has activated the dispensing means 134.

Additionally or alternatively, the retrofit device 110 may be configured to monitor the dispensing means 134 of the conventional device 100 directly. In such embodiments, a sensor (not shown) may be employed to indicate to the processor 46 when the dispensing means 134 of the conventional device 100 is activated. For example, at least one of the sensor/emitters 44 of the retrofit device 110 may comprise an infrared beam positioned such that its detection zone encompasses the area of the dispensing means 134. Accordingly, when a hand or other object is detected within the detection zone, the relevant sensor/emitter 44 signals the processor 46.

Further options include monitoring the volume of the sanitizer within the sanitizer container (or changes thereof). For example, in at least one embodiment utilizing this configuration, because the processor 46 of the circuit board 20 can determine if and when a user activates the dispensing means 134 of the conventional device 100, the processor 46 can also determine that the volume of sanitizer in the sanitizer container has been reduced. In this manner, the retrofit device 110 can be used to monitor the remaining volume of the sanitizer within the sanitizer container and, if desired, provide alerts in the event sanitizer levels fall below a desired threshold.

In operation, hygiene maintenance device 10 and retrofit device 110 function to monitor ingress and egress from a hygiene sensitive area and facilitate good hygiene practices. Perhaps more specifically, the devices 10, 110 may be used to monitor, facilitate, and potentially record user hygiene practices through the use of its sensor/emitter(s) 44 and strategic alerts. For example, in at least one embodiment, device 10, 110 may be installed such that it monitors a detection zone comprising a doorway into a room. While the description of the operations and functionality will now be described in connection with the hygiene maintenance device 10, it will be appreciated that this is done solely for the sake of providing a clear and concise description of the devices and systems of the present disclosure and any such descriptions are equally applicable to and representative of the operation and functionality of the retrofit device 110.

If a sensor/emitter 44 detects a user passing within its sensing range (i.e. the detection zone), and if a sanitizer is not dispensed from the device 10, 110 within a specified period of time, an alert (i.e. negative feedback) will be issued such as a voice alarm in English (and/or in other appropriate languages) with an adjustable, time-cycled volume control that says "You must cleanse hands." Alternatively, an audible tone may be presented instead. In addition, a visual alarm may be activated (i.e. visual negative feedback). Such alert(s)/alarm(s) may be repeated (at intervals or continually) unless and until the user sanitizes his or her hands and, thus, sanitizer is dispensed from the device 10, 110. In this manner, the device 10, 110 functions as negative feedback until the user complies with the prescribed hygiene practices.

As previously noted, the device 10 may optionally be configured to record and store certain operational data relating to user hygiene practices. In at least one such embodiment, if the sanitizer is not dispensed after 2 alerts (or after the number of alerts specified by an administrator), a "non-compliant event" is recorded and stored. All "compliant events" may be recorded and stored as well. All such logs of events are stored in the local storage components 50 of the device 10 or, where the device 10 is in communication with a network, the log file(s) may be stored in one or more networked databases. The logs are stored as .csv, .txt, or any other file type as desired. Furthermore, in addition to raw operational data, the logs may also provide records relating to each event including (without limitation), a unique ID associated with the relevant hygiene maintenance device 10, the date and time of the event, whether an alert was presented and what type, whether a sensor/emitter 44 detected an individual, whether the detection resulted in a compliant or non-compliant event, an approximate amount of sanitizer remaining in sanitizer container 14 following the event, and any other data that may be deemed useful by the operator.

Device 10 may also be programmed to record and store operational data for some users, but not others. For example, where the hygiene maintenance device 10 is configured to recognize and identify credential information, the device 10 can record and store operational data for credentialed users, but not non-credentialed users. In at least one embodiment, if the device 10 identifies a credentialed user within the detection zone, in addition to providing alerts, it records and stores event-related data. Such data may be stored in the aggregate across all credentialed users, or it may be linked to the appropriate credentialed user's file. As with other aspects of the device 10, this functionality is entirely customizable. Indeed, any number of user groups may be identified (provided there a means is employed that enables the device 10 to determine match a user to a group—e.g., different credential information, badges, etc. for each group of users). Furthermore, as previously described, each group may be associated with specific detection profiles (consider, for example, where employee protocols may be more stringent than lay person protocols).

Device 10 continuously monitors the detection zone, compliance following a trigger event and, if desired, may transmit the logged information via the communication components 52 to local and/or central computers so compliance rates can be monitored for a particular room, a particular unit/ward, and/or a whole facility on a regular basis. However, note that the processor 46 of the device 10 is not necessarily constantly active and/or monitoring. Indeed, the processor 46 is not required to operate the sensor/emitter(s) 44 to monitor and/or detect a trigger event in the detection zone. Likewise, the processor 46 need not be active for the device 10 to detect operation of the dispensing means 34 via the switch 48. Instead, when a triggering event is logged by a sensor/emitter 44 or the dispensing means 34 is activated, the respective component sends a signal to the processor 46 and wakes it up. At that point, the processor 46 runs the appropriate logic or protocol, depending on which component of the device 10 sent the signal and pursuant to any established parameters (e.g., if the processor 46 receives a signal from the dispensing means 34 (via the switch 48 or otherwise), the processor 46 ignores any subsequent trigger event signal it may receive from a sensor/emitter 44 for a prescribed period of time, or if the processor 46 receives a signal indicative of a trigger event from a sensor/emitter 44, the processor 46 executes the appropriate compliance algorithm).

Figure 4:
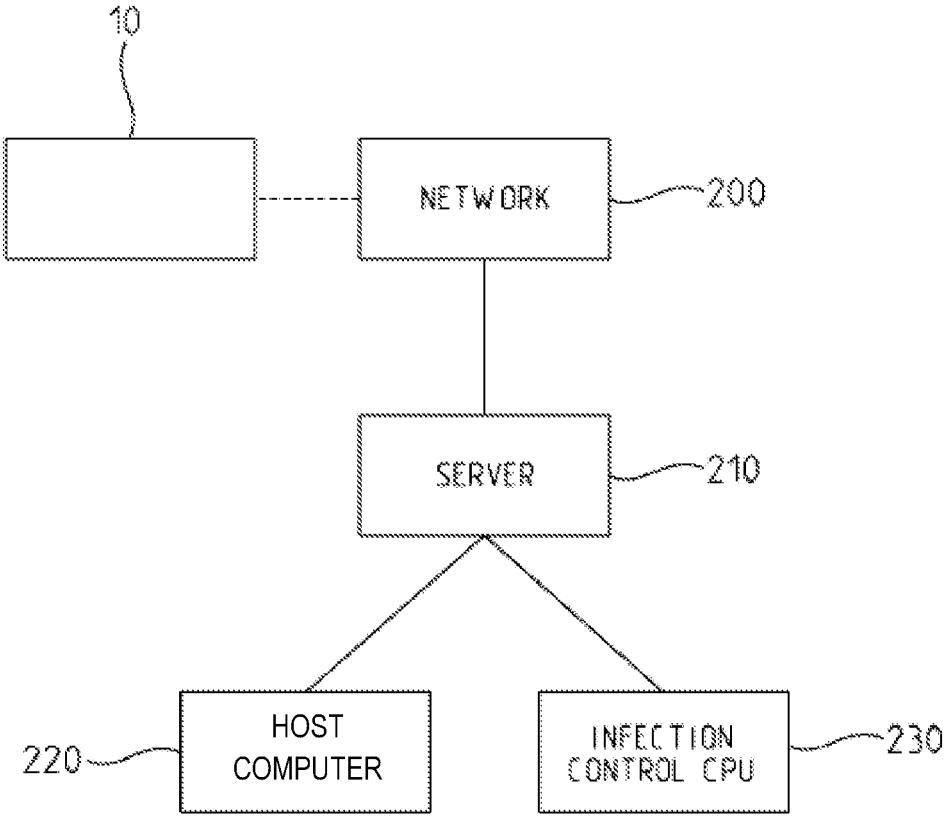
FIG. 4 is a schematic diagram of computing systems in communication with the hygiene maintenance device of FIGS. 1*a* and 1*b;*

FIG. 4 shows an example setup for the hygiene maintenance device 10 when setup in the network configuration. Device 10 communicates in any of the above described ways to network 200. Server 210 is coupled to network 200. Various other computers access server 210 either in real-time, near real-time, or at a later time to access the compliance and operational data received from the device 10. In such embodiments, the host computer 220, such as a unit nurses' station computer for example, may be used to monitor the operational status of device 10. Faults in device 10 and low sanitizer warnings are provided to host computer 220 via the network 200 to inform of the need for maintenance of device 10. Compliance data (real-time, near real-time, or historical) can also be provided to computer 220 if desired. Real-time compliance data can be useful for prompting staff to encourage compliance or to educate non-healthcare workers (such as visitors) regarding hygiene requirements. Infection control computer 230 is provided as a device to access, synthesize, and produce reports regarding the compliance data. The programming of infection control computer 230 can include programs that are set to monitor data in server 210 for certain conditions and generate remedial protocols or note particularly well performing areas. Infection control computer 230 generally allows for manipulation of the data of server 210.

Although infection control 230 and data server 210 are described herein as separate and dedicated pieces of hardware, this is merely intended to indicate separate functions of the system and is in no way intended to be limiting. Depending on the size of the system and user preference, both functions may occur on the same physical device, they may operate as a program or application on an existing computer, or these functions may be performed via a computer interface that merely accesses data and/or reports that are maintained on an independent system in the same manner as accessing a webpage (e.g., through a web portal, hosted software, or the like). Furthermore, while only one device 10 is shown in this embodiment, it will be appreciated that this is for explanatory purposes only and any number of hygiene maintenance devices 10 may be employed in connection with the network 200 and configuration (or variations thereof) illustrated in FIG. 4.

Figure 5A:
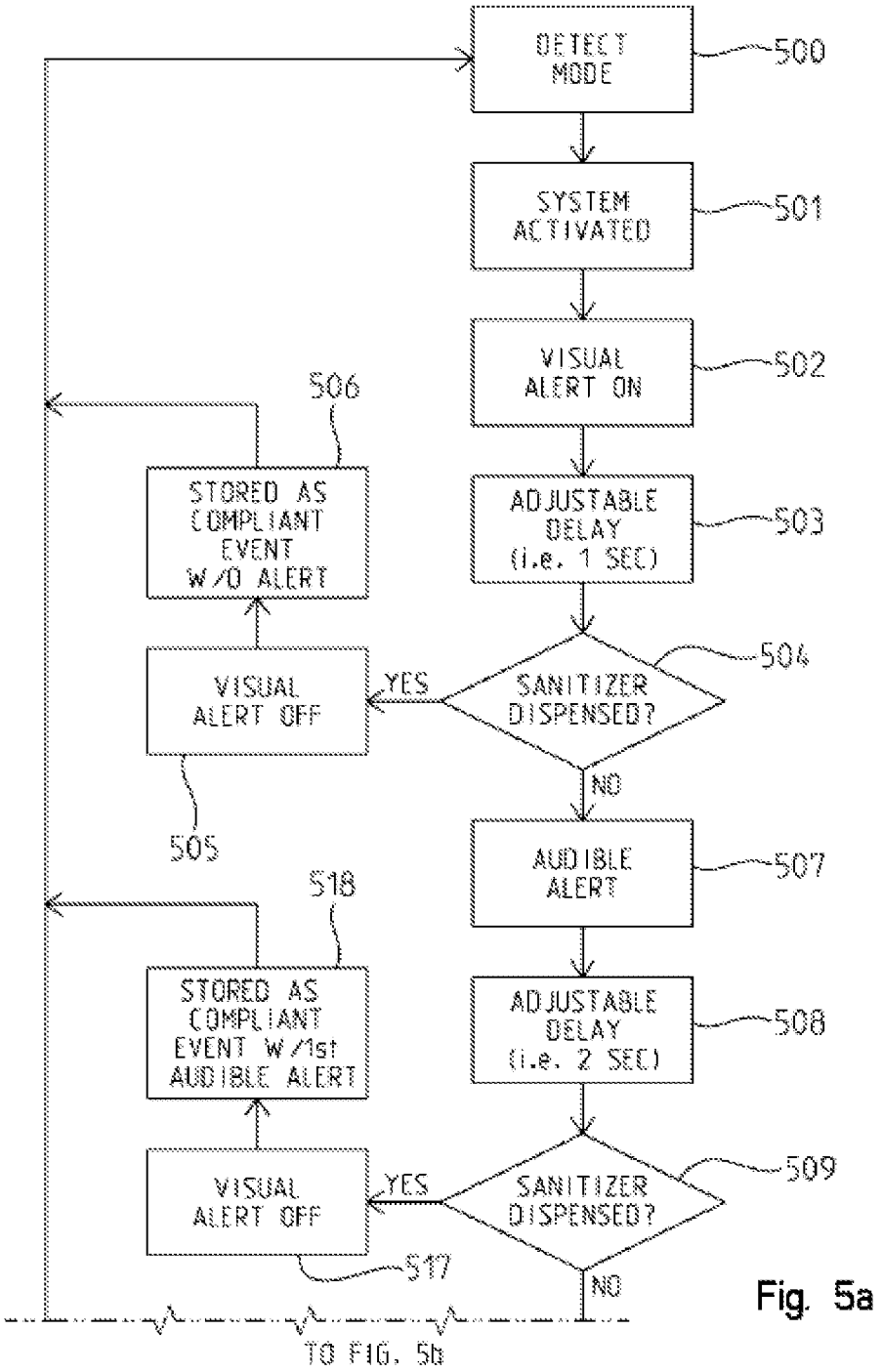
FIG. 5*a-c* depict flow charts showing the functional process followed by the hygiene maintenance devices of FIGS. 1*a*, 1*b*, and 3.
Figure 5B:
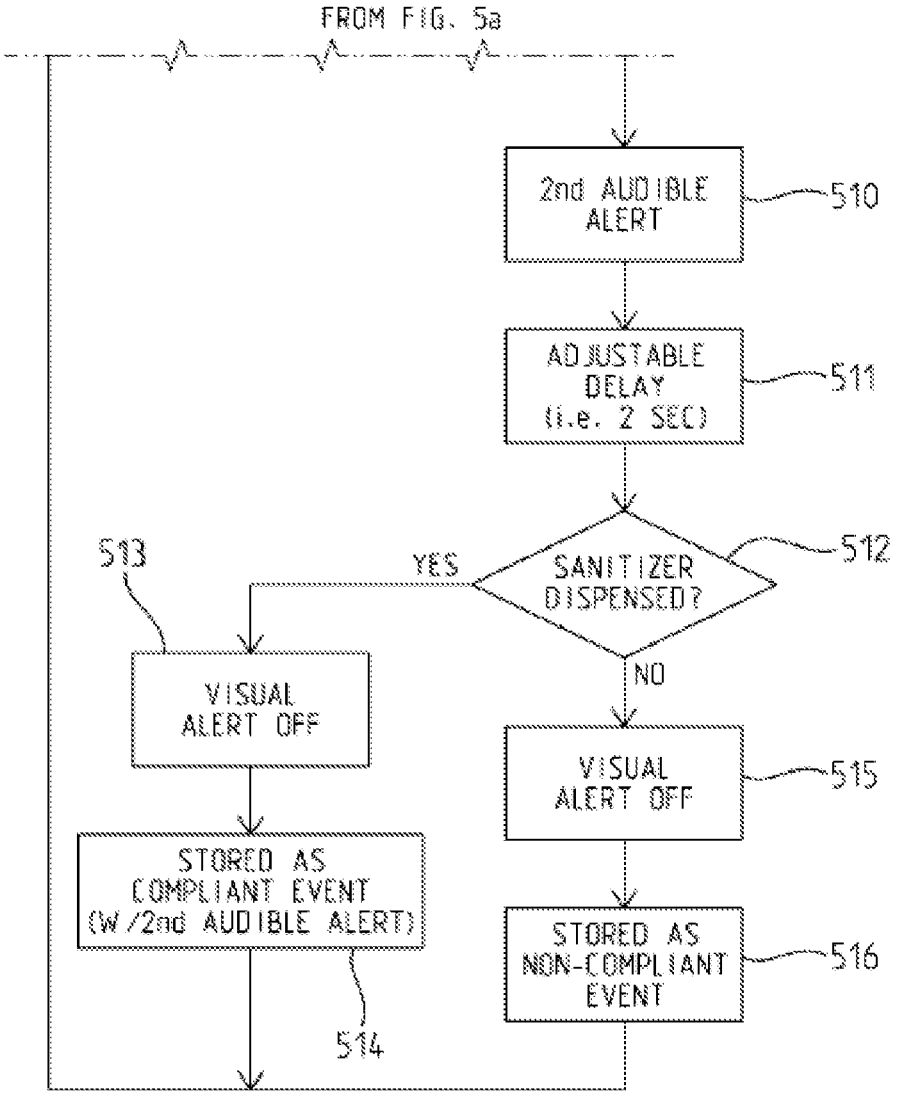

The definition for a compliant event can be adjusted and dictated as desired. One exemplary protocol for determining the compliant/non-compliant status of an event is shown in FIGS. 5*a* and 5*b*. The processor 46 sits in detect mode at step 500 (its lower-power sleep state) waiting for an activation. At step 500, the sensor/emitter(s) 44 are continuously monitoring the detection zone for a trigger event. In the event a sensor/emitter 44 detects the presence of an individual within its detection zone, the protocol advances to step 501 and the processor 46 activates (or "wakes-up") the system. In at least one embodiment, this results in the activation of display 23 by the processor 46, step 502. The processor 46 then waits a first delay time, step 503. The first delay time is adjustable and can be customized on a site, ward, room, or other basis. An exemplary delay time is provided as one second. Following step 503, the processor 46 checks to see if dispensing means 34 has been activated at step 504. If dispensing means 34 has been activated, the processor 46 turns off the visual alert indicated by the display 23 at step 505 and (optionally) stores the event in the event log as a compliant event without alert, step 506. The processor then returns to detect mode, step 500.

Alternatively if, at step 504, the dispensing means 34 has not been activated, the protocol advances to step 507 and the processor 46 sounds an audible alert via the speaker 22. The processor 46 then waits a second delay time, step 508. At step 509, the processor again checks if dispensing means 34 has been activated. If dispensing means 34 has been activated, the processor 46 turns off the visual alert provided via display 23 at step 517, and (optionally) stores the event in the event log as a compliant event with first audible alert, step 518.

If, at step 509, the dispensing means 34 has not yet been activated, the protocol advances to step 510. At step 510, the processor 46 sounds a second audible alert. The processor 46 then waits a third delay time, step 511, and, following the third delay time, at step 512 the processor again checks if dispensing means 34 has been activated. If dispensing means 34 has been activated, then the processor 46 turns off the visual alert, step 513, and (optionally) stores the event in the event log as a compliant event with a second audible alert, step 514. The processor 46 then returns to detect mode, step 500.

In the event the protocol reaches step 512 and the dispensing means 34 has not been triggered, the processor 46 turns off the visual alert at step 515 and (optionally) stores the event in the event log as a non-compliant event, step 516. The processor 46 then returns to detect mode, step 500. It will be appreciated that the first, second, and third delay times may each be customized pursuant to user/administrator preference and are likewise adjustable following installation, if desired. Furthermore, the specific sequence and number of steps, and the parameters of the adjustable delays may be modified as appropriate pursuant to the desired applications of the protocol. Finally, as previously noted, the characteristics of the alerts (both visual and audible) can be customized and/or assigned pursuant to user/administrator preference in accordance with the time of day and/or any other user-identified criteria (e.g., a user can define the first audible alert to be a first phrase spoken in English and the second audible alert to be a second phrase spoken in English).

Figure 5C:
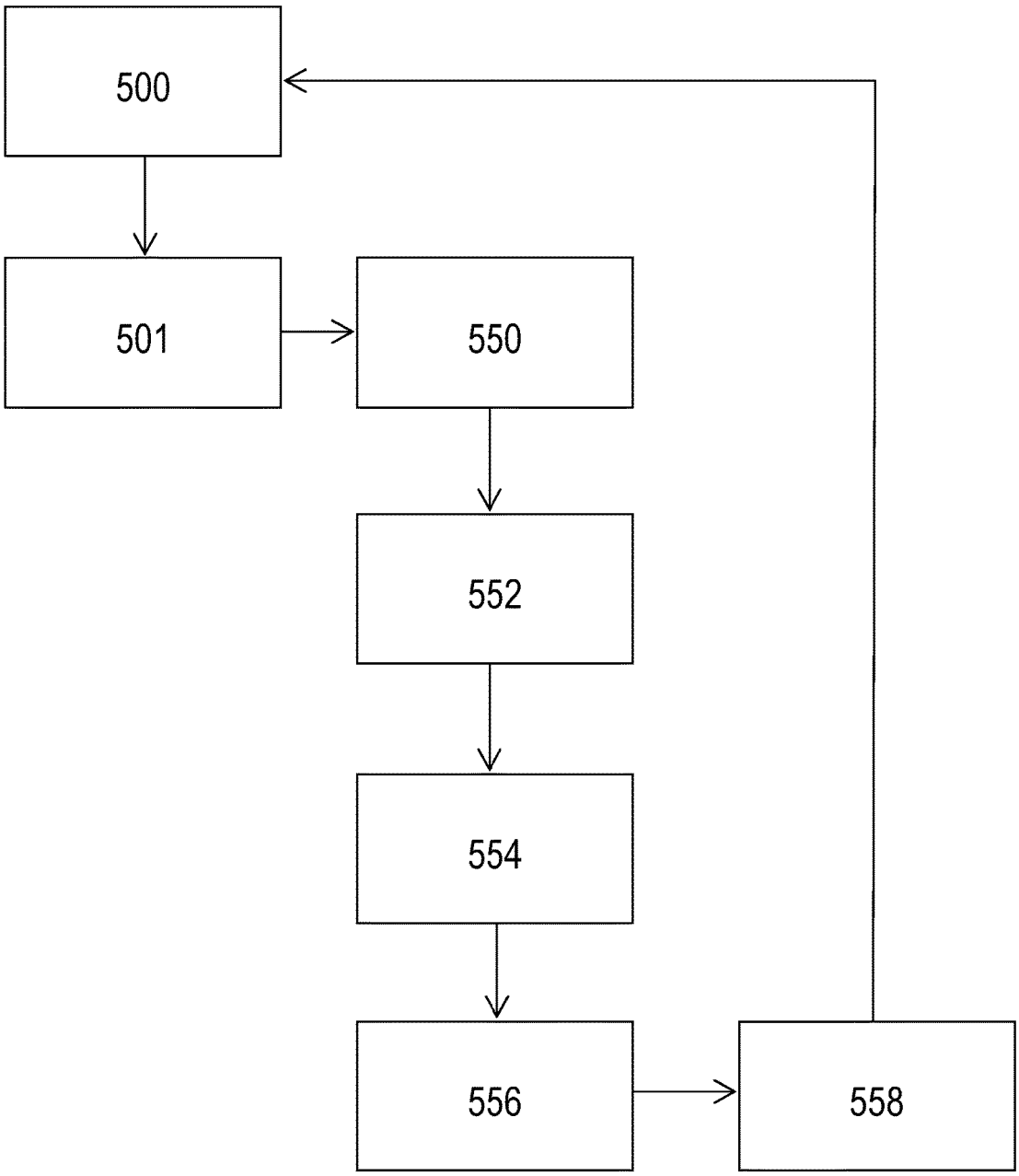

Now referring to FIG. 5*c*, a flow chart representing at least one embodiment of an optional sub-protocol is shown. Embodiments of this sub-protocol may be performed in connection with the previously described protocols of FIGS. 5*a* and 5*b* when it is desirable for exceptions to be incorporated into the protocol (e.g., to reduce the incidence of system errors associated with false non-compliant events).

As shown in FIG. 5*c*, the processor 46 sits in detect mode and the sensors/emitters 44 continuously monitor their respective detection zones at step 500 as previously described. If, at step 501, the device 10 detects activation of the dispensing means 34, 134, the protocol advances to step 550 and an exception is recognized. In at least one embodiment, this results in the activation of a display 23 by processor 46 at step 552. The processor 46 then ignores any trigger events that may be detected by a sensor/emitter 44 for an adjustable period of time, step 554. Upon the conclusion of the adjustable period of time, at optional step 556, the processor 46 turns off the visual alert indicated by the display 23 (if used) and optionally stores the event and exception in the event log as a compliant event, step 558. The processor 46 then returns to detect mode at step 500. In this manner, the sub-protocol provides a mechanism through which to discount a trigger event that occurs in close succession to sanitizer being dispensed, such as when a user sanitizes their hands prior to moving through a detection zone upon exiting a room, thereby providing more accurate compliance data.

When hygiene compliance rates are below appropriate levels in a certain area, training may be instituted in the flagged units and follow-up compliance rates may subsequently be monitored. Additionally, in at least one embodiment, the device 10 may also comprise a visual alarm, e.g., LED 26, for indicating when the level of sanitizer is low in the device 10 such that the device 10 can be refilled or if there is a malfunction detected in the device 10. For example, an auditory alarm may sound, via speaker 22, if the sanitizer is not replaced in a specified amount of time or if the malfunction is not fixed.

Similarly, in embodiments where device 10 uses AC power from a wall outlet an alarm sounds if device 10 becomes unplugged.

Initially, close to the time of implementation, it would be expected for there to be a higher number of alarms/alerts triggered. However, these alarm instances are expected to decrease as the hygiene task becomes a learned behavior. It would also ensure that this reminder remained present if compliance rates decreased due to factors such as new personnel or times of understaffing or overcrowding.

As evidenced by the above described example protocol, detection of a user initiates the protocol. Accordingly, accurate and reliable detection of the user is needed. Accordingly, the positioning of sensor/emitter 44 can affect the operation of the system. Positioning of sensor/emitter 44 is determined by taking the layout of the monitored area into account and optimal positioning will be dependent upon the space at issue. FIGS. 6*a-f* show various illustrative (albeit non-limiting) positioning options usable with various area layouts.

Figure 6A:
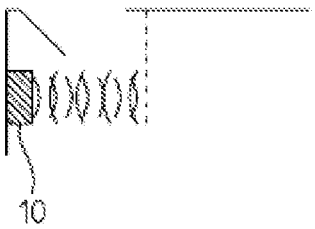
FIGS. 6*a*-6*f* are overhead schematic views of embodiments of room setups using the hygiene maintenance device of FIGS. 1*a*, 1*b*, and 3*a*.
Figure 6B:
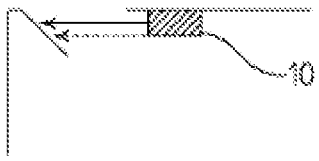
Figure 6C:
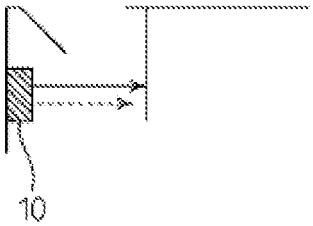
Figure 6D:
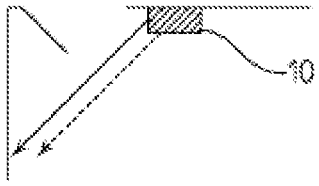
Figure 6E:
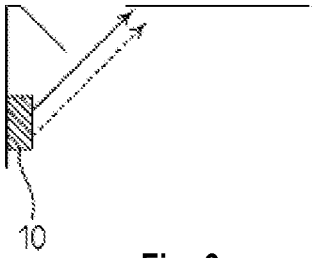

FIGS. 6*b*, 6*c*, 6*d*, and 6*e* show room layouts with device 10 placed proximate the door. Sensor/emitter 44 is provided as a two-part sensor/emitter 44 that provides two beams (optionally) in the detection zone. Here, the two beams optionally allow directionality to be discerned for a user that traverses the detection zone. In sum, hygiene maintenance device 10 is positioned such that anyone entering or leaving the room necessarily enters the detection zone, resulting in a trigger event. The arrangements shown in FIGS. 6*a* and 1*c* show devices 10, 110 using an ultrasonic detection method. Sensor/emitter 44 is optionally configured to provide a distance parameter such that movement before and beyond a defined distance is not captured. This prevents general movement within the room, but away from the door, from triggering the device. FIGS. 6*d* and 6*e* show similar hygiene maintenance device 10 positioning with differing angle adjustments of sensor/emitter 44.

Figure 6F:
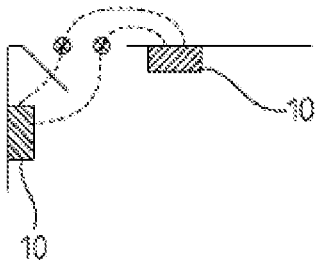

FIG. 6*b* shows a positioning suitable most readily for RFID detection method. Device 10 is located proximate the door on the same wall as the door. (It should be appreciated that "door" is being used as a generic term for an ingress/egress point. Furthermore, while placement of device 10 on walls is discussed, embodiments are envisioned where device 10 is on a moveable stand but oriented relative to an egress point consistently with the provided examples herein.) While FIG. 6*b* is described as being most readily suitable for RFID, the adjustable nature of sensor/emitter 44 provides that the other detection methods may also be usable with such placement. FIG. 6*d* shows device 10 having similar placement, with sensor/emitter 44 being adjusted to define different detection zones. Somewhat similarly, FIG. 6*f* shows similar positioning of hygiene maintenance device 10 that uses remote sensor/emitter 44. These remote sensor/emitter 44 are wired or wirelessly coupled to hygiene maintenance device 10. As shown in FIG. 6*f*, the use of remote sensor/emitter 44 allows multiple positions for hygiene maintenance device 10. (While FIG. 6*f* shows multiple hygiene maintenance devices 10, only one would need to be coupled to remote sensor/emitter 44.)

FIG. 6*c* shows a positioning particularly suitable when the ingress/egress point includes an internal hallway. Specifically, here remote sensor/emitter 44 is positioned to create a detection zone across the hallway. The embodiments of FIGS. 6*a-f* are exemplary and not intended to be limiting or exhaustive.

Besides hospitals and other medical environments, device 10, in its various forms, could have applicability for nursing homes, businesses, restaurants, schools, child care facilities, food handling areas, and any other areas where hand hygiene is important for infection control and general health. It may also be applicable in some "clean room" manufacturing environments or any other environment where it could be beneficial to facilitate consistent hygiene.

While various embodiments of the devices, systems and methods of the present disclosure have been described in considerable detail herein, the embodiments are merely offered as non-limiting examples. Many variations and modifications of the embodiments described herein will be apparent to one of ordinary skill in the art in light of the disclosure. It will therefore be understood by those skilled in the art that various changes and modifications may be made, and equivalents may be substituted for elements thereof, without departing from the scope of the present disclosure. The present disclosure is not intended to be exhaustive or limiting with respect to the content thereof. The scope of the disclosure is to be defined by the appended claims, and by their equivalents.

Furthermore, in describing representative embodiments, the present disclosure may have presented a method and/or a process as a particular sequence of steps. However, to the extent that the method or process does not rely on the particular order of steps set forth therein, the method or process should not be limited to the particular sequence of steps described, as other sequences of steps may be possible. Therefore, unless expressly stated otherwise, the particular order of the steps disclosed herein should not be construed as limitations of the present disclosure. In addition, any claims directed to a method and/or process should not be limited to the performance of their steps in the order written (unless expressly specified otherwise), and one skilled in the art can readily appreciate that the sequences may be varied and still remain within the scope of the present disclosure.

The invention claimed is:

1. A hygiene facilitation device comprising:

two or more sensors, at least one first sensor configured to detect the presence of an individual moving through a detection zone and at least one second sensor configured to detect activation of a dispensing means of a hygiene material container;

a first housing comprising a coupler for coupling the first housing to a surface;

at least one display positioned on the first housing and configured to provide visual information; and a circuit board positioned within the first housing, comprising a processor, and coupled with a power supply, the circuit board in communication with each of the sensors and each of the display(s);

wherein upon detection of a trigger event by at least one of the first sensors, the processor provides a first alert unless and until at least one of the at least one second sensors detects activation of the dispensing means of the hygiene material container;

wherein activation of the dispensing means of the hygiene material container results in the release of hygiene material from the hygiene material container and the first housing is independent of and not contained with the hygiene material container; and wherein the hygiene material container is positioned within a second housing, the dispensing means is coupled with the second housing, the coupler of the first housing is configured for snap-on coupling with the second housing or for mounting to a vertical surface, the first housing further comprises a drip tray positioned such that when the coupler of the first housing is coupled with the second housing, the drip tray is positioned below the dispensing means of the second housing, and the at least one second sensor is positioned on the drip tray.

2. The hygiene facilitation device of claim 1, further comprising at least one speaker coupled with the first housing, the at least one speaker in communication with the processor and configured to provide audible information;

wherein the first alert is delivered at least in part through the at least one speaker.

3. The hygiene facilitation device of claim 1, wherein:

at least one of the at least one first sensor is configured to determine a direction of travel of an individual moving through the detection zone;

detection of a first trigger event comprises detection of any individual moving through the detection zone in a defined direction by the first sensor; and the first alert comprises a light emitted through the at least one display.

4. The hygiene facilitation device of claim 1, wherein upon detection of a second trigger event:

the processor provides a second alert;

the second trigger event comprises detection of activation of the dispensing means by the second sensor; and the processor disregards any detection of the first trigger event that occurs within a preset time of the second trigger event.

5. The hygiene facilitation device of claim 1, wherein:

the hygiene facilitation device further comprises at least one data storage component in communication with the processor and comprising parameters defining one or more trigger events and one or more sets of executable instructions stored thereon; and upon detection of a trigger event by at least one of the first sensors, the processor executes the first set of executable instructions which causes the processor to additionally perform the steps of:

(a) providing the first alert via at least one or more of the displays;

(b) determining if the dispensing means is activated within a first preset time of the trigger event; and (c) choosing between and executing one of:

if the dispensing means is activated within the first preset time, ceasing the first alert and logging a compliant event by saving a record to the data storage component, or if the dispensing means is not activated within the first preset time, providing a second alert via at least one or more of the displays, and the first set of executable instructions further cause the processor to perform the step of choosing between and executing one of:

if the dispensing means is activated within a second preset time of the trigger event, logging a compliant event by saving a record to the data storage component, or if the dispensing means is not activated within the second preset time, issuing third alert via at least one or more of the displays and logging a non-compliant event by saving a record to the data storage component.

6. The hygiene facilitation device of claim 5, wherein:

the first trigger event comprises detection of any individual moving through the detection zone by the first sensor;

the first sensor is additionally configured to detect if the individual moving through the detection zone is associated with credentials;

the processor is configured such that the relevant portion of step (c) regarding the logging of a compliant or non-compliant event is only executed by the processor if the individual moving through the detection zone is associated with credentials.

7. The hygiene facilitation device of claim 2, wherein information provided via the at least one display and/or the at least one speaker is programmable such that the information may be customized to each trigger event and/or each alert delivered.

8. The hygiene facilitation device of claim 2, wherein the processor is communicatively coupled with a clock for measuring time, and the volume and/or brightness of the alerts are customizable pursuant to the time of day indicated by the clock.

9. The hygiene facilitation device of claim 1, further comprising at least one third sensor for coupling with the hygiene material container such that the at least one third sensor can monitor a volume of hygiene material within the hygiene material container, the at least one third sensor in communication with the processor; and wherein the hygiene material container is positioned within a second housing, the dispensing means is coupled with the second housing, and the surface to which the coupler of the first housing is configured to couple is a vertical surface adjacent to the second housing.

10. The hygiene facilitation device of claim 5, wherein the at least one data storage component is selected from the group consisting of on-board dedicated storage, removable media, and a remote database associated with a server in communication with the processor over a network.

11. The hygiene facilitation device of claim 1, wherein the at least one first sensor is adjustable such that the associated detection zone is modifiable in size and shape.

12. The hygiene facilitation device of claim 1, wherein the shape, size, and/or location of the detection zone is customizable and the processor is programmed such that any trigger event detected outside of the detection zone does not cause the processor to execute the first set of executable instructions.

13. A hygiene facilitation system comprising:

a hygiene device consisting of a hygiene material container and a dispensing means, the hygiene material container positioned within a case and the dispensing means coupled with the case and configured to release hygiene material from the hygiene material container upon activation; and a retrofittable hygiene facilitation device comprising:

a housing independent of the hygiene device and comprising a coupler for coupling the housing to a surface on or adjacent to the case of the hygiene device, two or more sensors, at least one first sensor configured to detect the presence of an individual moving through a detection zone and at least one second sensor configured to detect activation of the dispensing means of the hygiene device, at least one display positioned on the housing and configured to provide visual information, at least one speaker configured to provide audible information and coupled with the housing, a circuit board positioned within the housing, comprising a processor, and coupled with a power supply, the circuit board in communication with each of the sensors, the display(s), and the speaker(s), and at least one data storage component in communication with the processor, the data storage component comprising parameters defining one or more trigger events and one or more sets of executable instructions stored thereon, wherein execution of a first set of executable instructions by the processor causes the processor to perform the steps of:

(a) providing a first alert via at least one or more of the displays, (b) determining if the dispensing means is activated within a first preset time of a trigger event, and (c) choosing between and executing one of:

if the dispensing means is activated within the first preset time, ceasing the first alert, or if the dispensing means is not activated within the first preset time, providing a second alert via at least one or more of the displays;

wherein the execution of the first set of executable instructions by the processor is caused by the detection of a first trigger event comprising detection of any individual moving through the detection zone by the first sensor, and at least one of the at least one second sensors of the retrofittable hygiene facilitation device is coupled with the hygiene material container to detect activation of the dispensing means by monitoring a volume of hygiene material within the hygiene material container.

14. The hygiene facilitation system of claim 13, wherein the housing of the retrofittable hygiene facilitation device further comprises an accessory mounted to the case of the hygiene device, the accessory selected from a group consisting of a drip tray and a towel dispenser.

15. The hygiene facilitation system of claim 13, wherein the processor is configured such that the choosing and executing of step (c) additionally comprises:

logging a compliant event by saving a record to the data storage component if the dispensing means is activated within the first preset time, or choosing and executing one of the following if the dispensing means is not activated within the first preset time:

if the dispensing means is activated within a second preset time of the trigger event, logging a compliant event by saving a record to the data storage component, or if the dispensing means is not activated within the second preset time, issuing a third alert via at least one or more of the displays and logging a non-compliant event by saving a record to the data storage component.

* * * * *